US006260220B1

(12) United States Patent
Lamb et al.

(10) Patent No.: US 6,260,220 B1
(45) Date of Patent: Jul. 17, 2001

(54) SURGICAL TABLE FOR LATERAL PROCEDURES

(75) Inventors: Steve R. Lamb, Pleasanton; Russell Klein, Redwood City, both of CA (US)

(73) Assignee: Orthopedic Systems, Inc., Union City, CA (US)

( * ) Notice: Subject to any disclaimer, the term of this patent is extended or adjusted under 35 U.S.C. 154(b) by 0 days.

(21) Appl. No.: 08/800,107

(22) Filed: Feb. 13, 1997

(51) Int. Cl.[7] ..... A61G 13/04

(52) U.S. Cl. ..... 5/607; 5/601; 5/608; 5/610; 5/621

(58) Field of Search ..... 5/600, 601, 607, 5/608, 609, 610, 611, 621, 622, 623

(56) References Cited

U.S. PATENT DOCUMENTS

| | | | | |
|---|---|---|---|---|
| 1,160,451 | | 11/1915 | Sanford . | |
| 1,662,464 | | 3/1928 | McCutchen . | |
| 2,636,793 | | 4/1953 | Meyer | 311/7 |
| 2,691,979 | | 10/1954 | Watson . | |
| 3,090,381 | | 5/1963 | Watson | 128/84 |
| 3,428,307 | | 2/1969 | Hunter et al. | 269/322 |
| 3,652,851 | | 3/1972 | Zaalberg | 250/54 |
| 3,739,406 | * | 6/1973 | Koetter | 5/611 X |
| 3,745,996 | | 7/1973 | Rush | 128/84 B |
| 3,751,028 | | 8/1973 | Scheininger et al. | 269/322 |
| 3,814,414 | | 6/1974 | Chapa | 269/323 |
| 4,545,571 | | 10/1985 | Chambron | 269/322 |
| 4,730,606 | | 3/1988 | Leininger | 128/75 |
| 4,866,796 | | 9/1989 | Robinson et al. | 5/62 |
| 5,088,706 | | 2/1992 | Jackson | 269/323 |
| 5,613,254 | | 3/1997 | Clayman et al. | 5/600 |

FOREIGN PATENT DOCUMENTS 1161638 9/1958 (FR) .

OTHER PUBLICATIONS

1991 Orthopedic Systems, Inc. Product Brochure for Jackson's Spinal Surgery and Imaging Table.
1994 Orthopedic Systems, Inc. Product Brochure for Universal Orthopedic Surgical and Fracture Table.
1994 Promotional literature for the Ref 207 and MIRA 208 Table.
1978 Universal Table For Orthopaedic Surgery and Traumatology IOR MOD. G.S.S., pages.

* cited by examiner

*Primary Examiner*—Michael F. Trettel
(74) *Attorney, Agent, or Firm*—Stallman & Pollock LLP

(57) ABSTRACT

A surgical table having a table top which extends between a pair of vertically extending posts and which is laterally rotatable about its longitudinal axis. The head and foot ends of the table may be raised or lowered as needed to position the patient in trendelenberg and reverse trendelenberg orientations. The table top is coupled to each of the posts by means of gimbals having perpendicular rotation axes which provide the degrees of freedom necessary to permit both lateral rotation (to any angle) and trendelenberg.

22 Claims, 13 Drawing Sheets

SURGICAL TABLE FOR LATERAL PROCEDURES

FIELD OF THE INVENTION

The present invention relates generally to the field of surgical tables. In particular, the invention relates to surgical tables used for procedures requiring lateral patient positioning.

BACKGROUND OF THE INVENTION

Certain surgical procedures require both anterior and posterior access. For example, spinal procedures can require surgical access from both the patient's back and the chest. During the course of a surgical procedure, the patient undergoing surgery cannot be turned over between the supine position, (on his or her back), and the prone position (face down) in order to provide both anterior and posterior access to the surgeon without breaking the sterile field and redraping the patient. Surgical tables which provide both anterior and posterior access are therefore desirable.

Many surgical procedures, particularly minimally invasive procedures, also require positioning the patient on a surgical table and elevating the foot end of the table (called "trendelenberg") in order to gain surgical access to a desired region by shifting the patient's organs towards his or her head. Trendelenberg may also be used to increase blood flow to the patient's head to minimize the risk of shock. Other procedures require reverse trendelenberg, in which the head end of the surgical table is elevated in order to give the surgeon access to difficult to reach areas of the body.

Oftentimes, procedures which require both anterior and posterior access will also require trendelenberg or reverse trendelenberg. It is thus desirable to provide a table which will accommodate anterior and posterior access in both trendelenberg and reverse trendelenberg positions.

One type of surgical table is available which allows anterior and posterior access plus trendelenberg during a single procedure. The table includes a table top mounted to a single pedestal centered beneath the table. While this table is effective for giving surgical access in each of the desired patient positions, the pedestal limits the lateral rotation to approximately +/−20°.

The pedestal table also presents difficulties when image intensification is used during the surgical procedure. An image intensification unit is comprised of an x-ray transmitter and an x-ray receiver positioned at the top and bottom, respectively, of a large C-shaped member. To use an image intensifier, the C-shaped member is positioned around the body portion sought to be imaged. X-rays are directed at the body by the x-ray transmitter and are received by the x-ray receiver. Image intensification units are mounted on a base having wheels so that the units may be rolled up to the patient for imaging and then rolled out of the way to allow the procedure to proceed. Because the pedestals utilized in existing tables are configured to balance and support the patient's weight, they extend fairly broadly beneath the table top and thus prevent access to the patient's body by the C-shaped image intensification unit.

Thus, anterior-posterior procedures are oftentimes completed using two surgeries, one in which the patient is in a supine position and (following healing of the first surgical site) a second in which the patient is prone. Other times, two surgeries are used in which the patient is laterally positioned with the chest facing the surgeon to permit anterior access, and another in which the patient is laterally with the patient's back facing the surgeon to permit posterior access.

The two-surgery method increases patient risk because it involves two anesthetizations and twice the healing time of a single surgical procedure, and because the patient is twice exposed to risk of infection. Moreover, the hospital costs required for two procedures are far greater than for a single procedure.

Surgical tables utilizing a table top extending between a pair of vertical posts facilitate C-arm imaging, but it will be appreciated that a two post table is not easily configured for combined lateral rotation (to any angle) and trendelenberg positioning. It is therefore desirable to provide a surgical table which allows anterior and posterior access during a single procedure, which can be adjusted to the trendelenberg and reverse trendelenberg conditions, and which permits the use of C-arm imaging equipment.

SUMMARY OF THE INVENTION

The present invention is a surgical table having a table top extending between a pair of vertically extending posts. The table is laterally rotatable about its longitudinal axis, and the head and foot ends of the table may be raised or lowered as needed to position the patient in trendelenberg and reverse trendelenberg orientations. The table top is coupled to each of the posts by means of gimbals having perpendicular rotation axes which provide the degrees of freedom necessary to permit both lateral rotation (to any angle) and trendelenberg.

DETAILED DESCRIPTION OF THE DRAWINGS

Structure

Figure 1A:
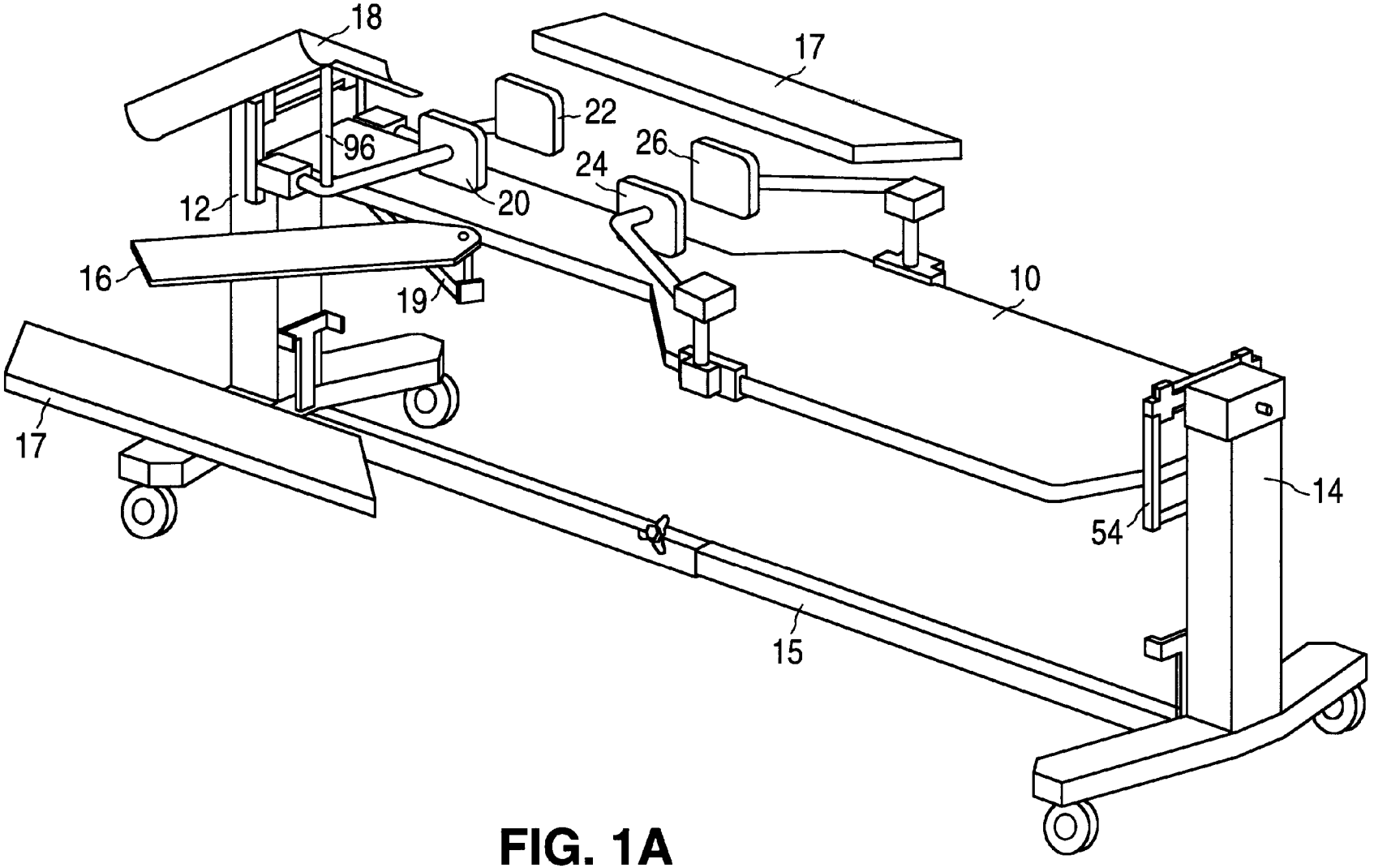
FIG. 1A is a perspective view of a surgical table according to the present invention.

Generally speaking, the present invention comprises a surgical table top 10 extending between a pair of vertical posts 12, 14 which, for the purposes of this description will be called the "head post" and "foot post," respectively. A base 15 extends across the floor space between the head and foot posts.

Several support devices are provided to secure patients in the lateral position on the table top 10. These devices include lower and upper arm boards 16, 18, chest and scapular pads 20, 22, and anterior thigh and sacral pads 24, 26. A head support (not shown) is also provided to securely hold the patient's head in order to prevent it from rolling or hanging and straps and/or other devices are provided to secure the patient's legs against the table. The chest pad 20 is designed to be positioned against the patient's chest, while the scapular pad 22 is positioned against the patient's shoulder blades. Likewise, the sacral pad 26 is designed to be positioned in the patient's lower back while the anterior thigh pad 24 positioned against the patient's upper thigh. Straps (not shown) are provided for securing the patient's arms to the arm boards 16, 18.

Table Top Structure

Figures 1B, 1C:
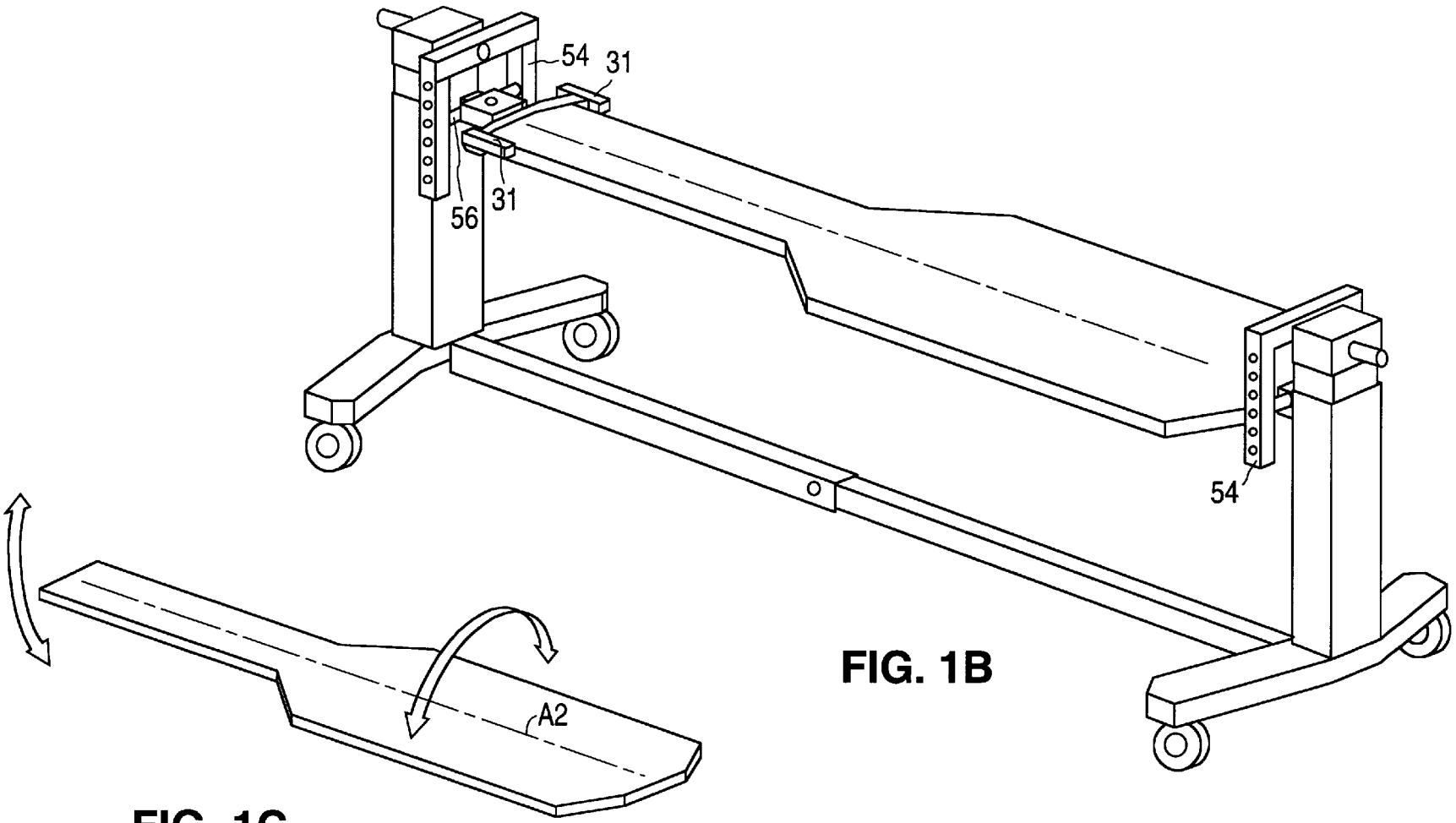
FIG. 1B is a perspective view of the surgical table of FIG. 1A with the transfer boards, arm boards, and patient support pads not shown.
FIG. 1C is a perspective view of the table top of the surgical table of FIG. 1A, with arrows indicating the lateral rotation and trendelenberg/reverse trendelenberg capabilities of the table top.
Figure 2:
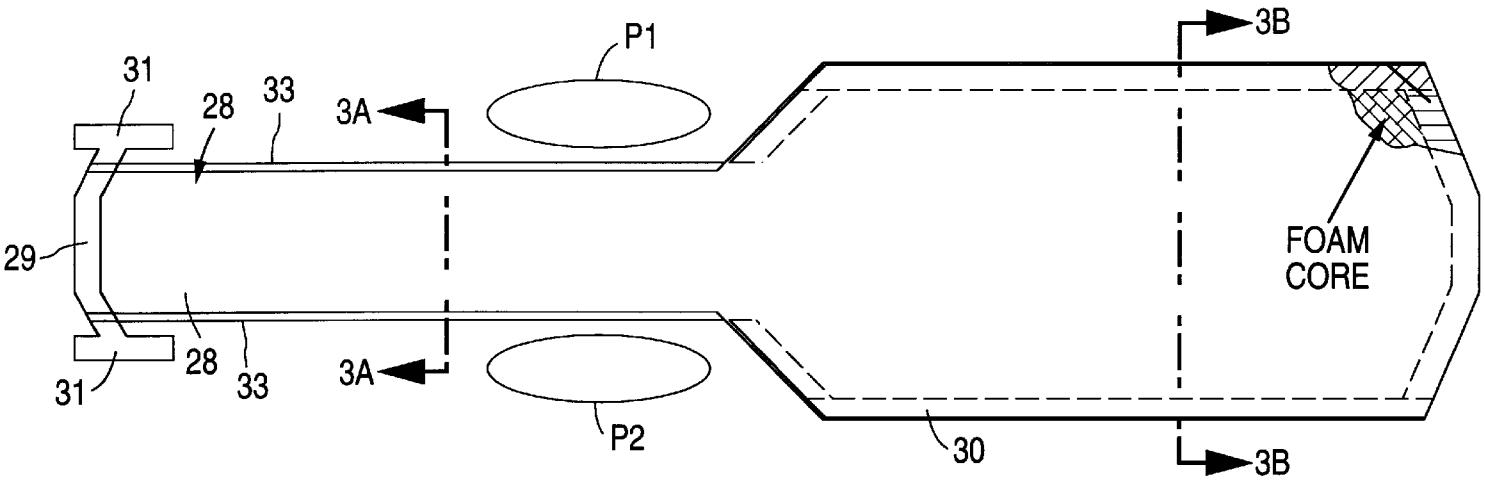
FIG. 2 is a plan view of a table top of the surgical table of FIG. 1A.

Referring to FIG. 2, the preferred surgical table top 10 includes a head section 28 and a foot section 30. The head section 28 is significantly narrower than the foot section 30. In the preferred embodiment the head section has a width of 9.5" while the foot section has a width of 21.5", which is a standard width for operating tables. The narrow head section 28 is of great benefit to a surgeon in that it permits the surgeon to stand very close to the patient, rather than requiring him or her to lean or extend towards the patient from an arm's length distance. Transfer boards 17 (FIG. 1) are attachable to opposite sides of the head section 28 to increase the width of the head section 28 to 21.5" during transfer of a patient onto the table top 10.

A rail 29 is mounted to the end of the head section 28 and supports a pair of mounting rails 31. Each of the mounting rails 31 is substantially parallel to one of the long sides 33 of the head section 28 of the table and, as described in detail below, each supports a clamp used for supporting a scapular pad or chest pad.

Figure 3A:
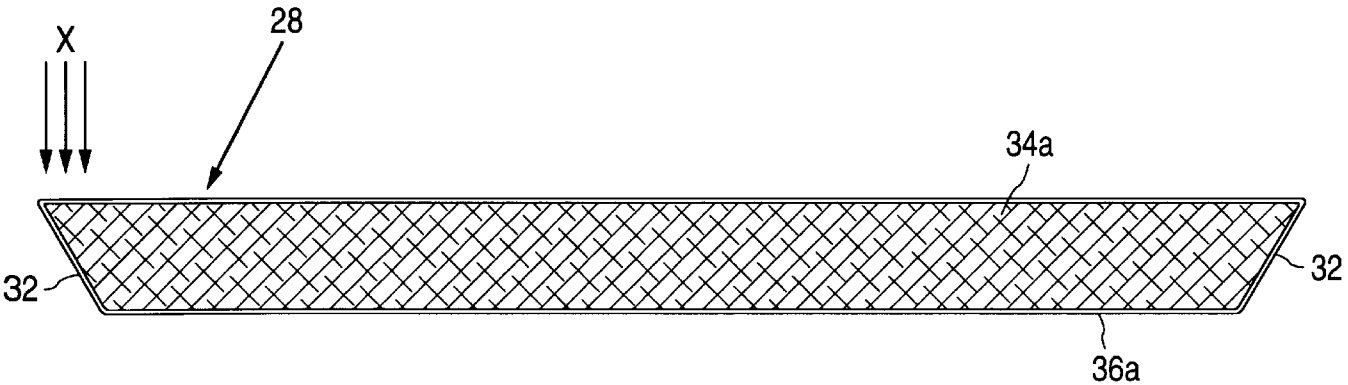
FIG. 3A is a cross-section view of the table top taken along the plane designated 3A—3A in FIG. 2.

A cross-section view of head section 28 of the table 10 is shown in FIG. 3A. The head section 28 of the table 10 is constructed of a foam core 34*a* which is encased in a carbon fiber reinforced epoxy surface 36*a*. Sides 32 of the head section 28 taper inwardly from the top surface of the table to the bottom surface of the table. This is important to optimizing the radiolucency of the table in that the carbon fiber epoxy surfaces 36*a* of the head section are always normal or oblique to x-rays X directed toward the table during x-ray imaging procedures. This minimizes formation of shadows on the x-ray images by reducing the maximum aggregate thickness of the carbon fiber reinforced epoxy surface.

Figure 3B:
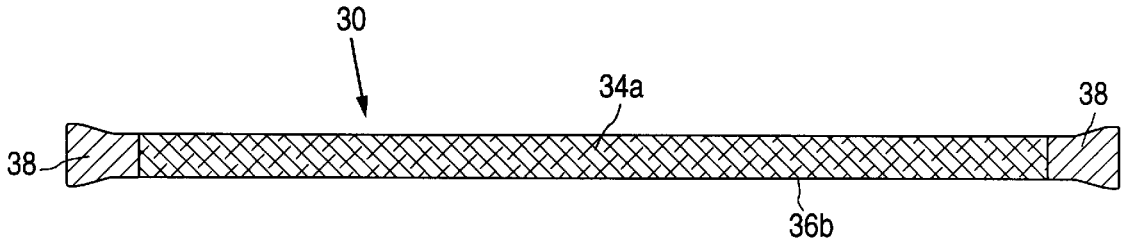
FIG. 3B is a cross-section view of the table top taken along the plane designated 3B—3B in FIG. 2.

FIG. 3B shows a cross-section of the loot section 30 of the table top 10. Foot section 30 includes a foam core 34*b* and a carbon reinforced epoxy surface 36*b*. Sides 38 of the foot section taper outwardly from the central portion of the table top. This shape is significant for two reasons. First, conventional devices for supporting patients' lower bodies in the lateral position (such as anterior thigh pads and sacral pads 24, 26) are designed to attach to conventional surgical tables which have rectangular edges. The table according to the present invention is designed for applications in which tremendous forces will be delivered to the lower body support pads, particularly when the table is rotated laterally to 45 degrees. It is therefore desirable to prevent the use of conventional lower body support pads on the table of the present invention because such conventional support pads may not have adequate load capacity.

Figure 3C:
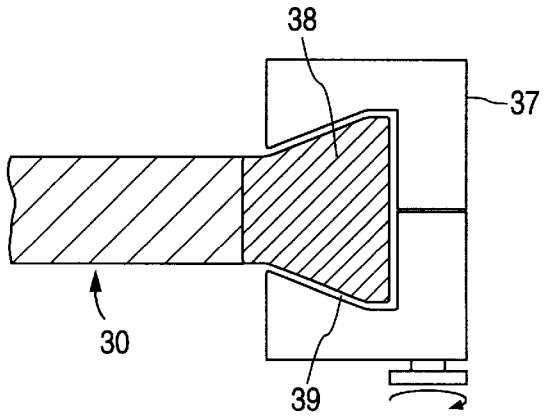
FIG. 3C is a partial cross-section view of the table top section of FIG. 3B showing the mating engagement between the tapered sides of the table top and corresponding tapered sides on a clamping device.

A further advantage to the tapered surfaces of side sections 38 is that they allow support devices to be more securely mounted to the table top 10. When clamping devices such as clamp 37 (FIG. 3C) having a corresponding taper are used to secure support devices to the table top 10, the tapered regions 38 provide a more secure locking surface and therefore minimize the chance that the clamps will slip out of position. Side sections 38 are phenolic covered with carbon fiber sheets in a composite construction.

Other table tops may alternatively be utilized in connection with the table of the present invention, including conventional rectangular table tops, and table frames, such as frame 210 which allows a patient to be strapped to the table in a prone position against various pads and arm boards.

Table Top Support Structures

Figure 4:
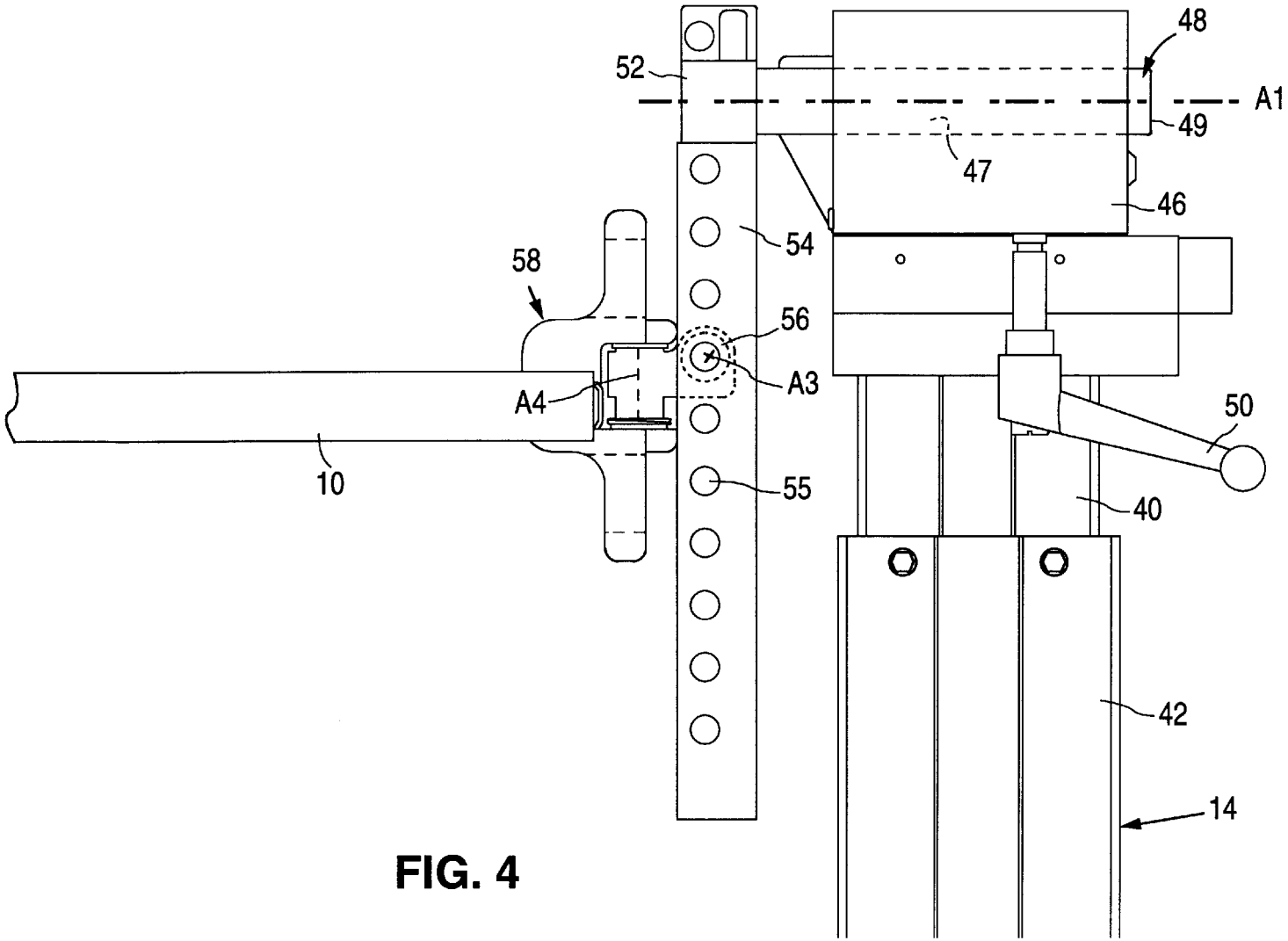
FIG. 4 is a partial side elevation view of the surgical table of FIG. 1A, showing the connection between the table top and the foot post.

FIG. 4 illustrates the features of the foot post 14 and the devices which link the table top 10 (or any other table top which may be adapted for use with the surgical table of the present invention) to the foot post 14. Because the head post 12 has identical features and connecting devices, a separate description of the head post and its associated linking devices will not be given.

Referring to FIG. 4, foot post 14 includes an upper post section 40 and a lower post section 42. Upper post section 40 is narrower in diameter than lower post section 42 and is telescopically and slidably received within lower post section 42.

Upper section 40 is slidable within the lower section 42 to raise or lower the height of the distal end (foot section) of the table top 10. Located inside the bottom section 42 is an electric motor, hydraulic pump, or other elevation means (not shown) for raising and lowering the upper section 40 relative to the lower section 42. The elevation means is actuated by means of a handheld keypad (not shown).

Figure 5:
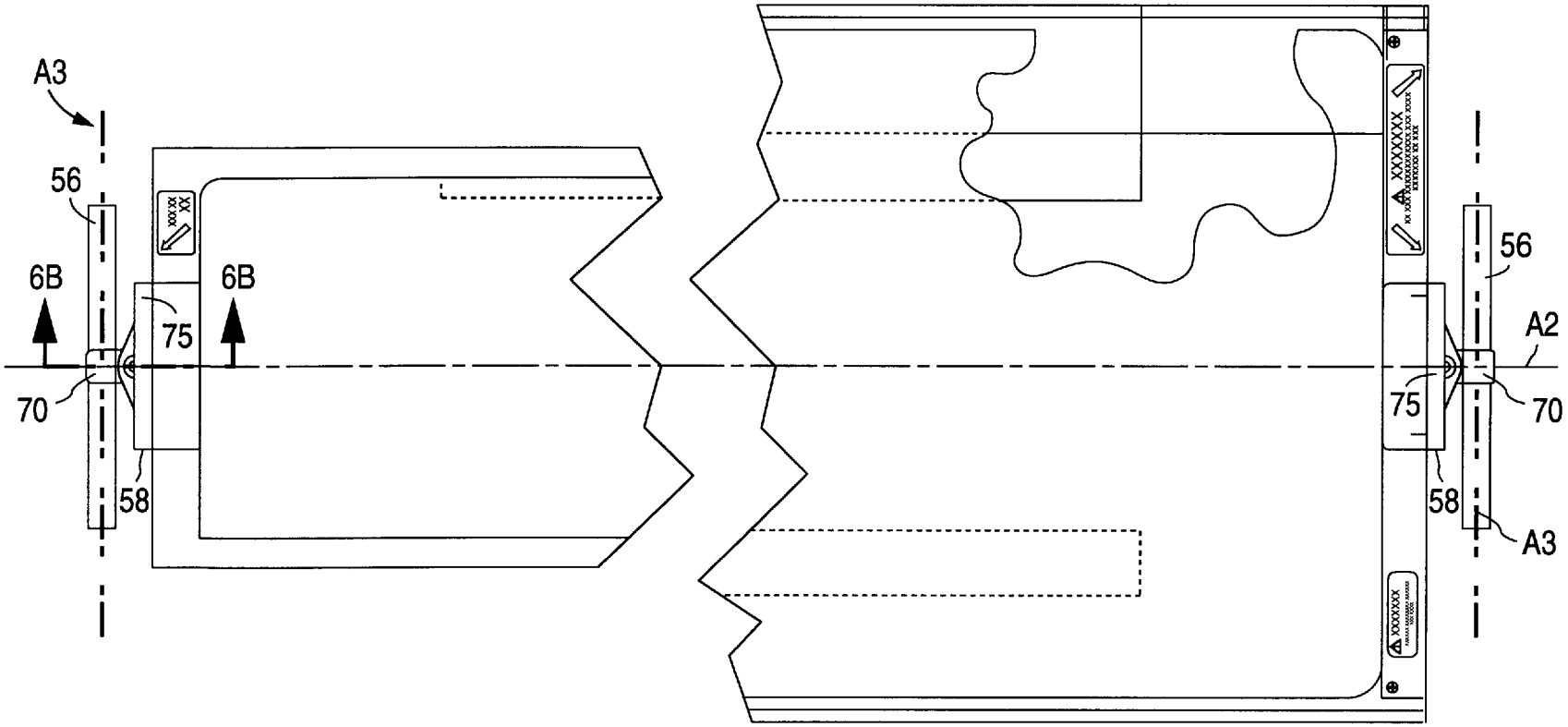
FIG. 5 is a plan view of the table top of FIG. 2 shown connected to the gimbals.

Mounted on top of the upper section 40 is a brake housing 46. A throughbore 47 passes through the housing 46. A shaft 48 having a rotation axis A1 is rotatably disposed within the throughbore 47, and a cross member 52 is fixed to one end of the shaft 48. When the table top 10 is not in a trendelenberg or reverse trendelenberg position, axis A1 is parallel to the longitudinal axis A2 (FIG. 5) of the table top 10. Free end 49 of the shaft 48 extends out of the housing 48.

Inside the brake housing 46 is a friction braking device (not shown) which is actuated by a brake lever 50. The braking device is designed to clamp the shaft 48 and to thereby prevent rotation of the shaft 48 when it is desired to prevent rotation of the table top 10. As further security against unwanted rotation, the housing 46 further includes a transfer lock (not shown) which engages with the cross-member to prevent rotation.

Shaft 48 is connected to cross member 52 which is in turn connected to a pair of downwardly extending connector bars 54 (one shown in FIG. 4, see also FIG. 1B). A rod 56 (FIG. 5) having a longitudinal axis A3 extends horizontally between parallel bars 54. A locking device (not shown) is provided to prevent the rod 56 from accidentally sliding out of place.

The above-described components (i.e. the shaft, braking device, cross member, and connector bars) are described in detail in application Ser. No. 08/512,281, now U.S. Pat. No. 5,658,315 which is incorporated herein by reference. These components, as well as the transfer lock, are also found on the Modular Table System available from Orthopedic Systems, Inc. of Union City, Calif.

Figure 6A:
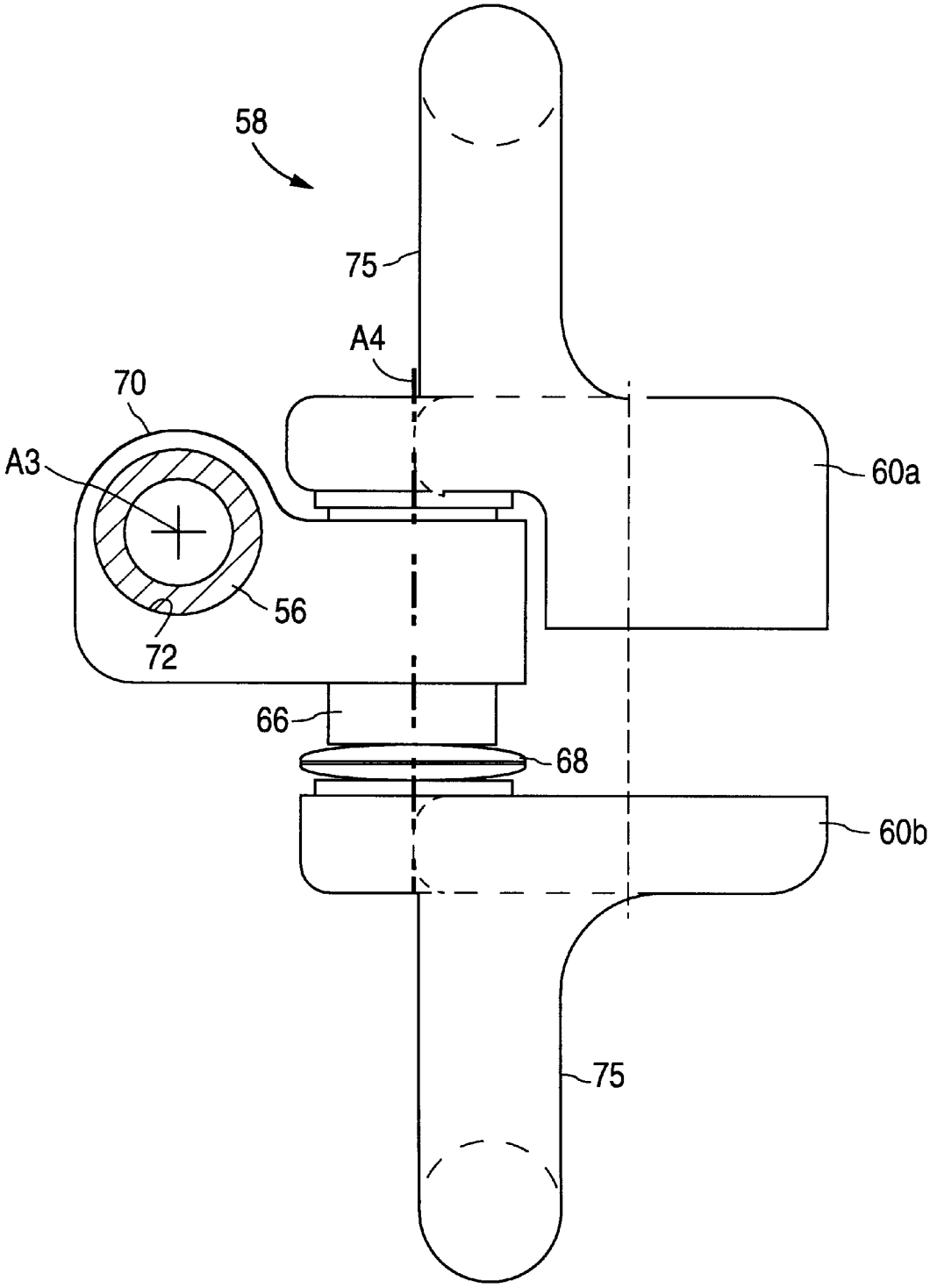
FIG. 6A is a side elevation view of a gimbal.
Figure 6B:
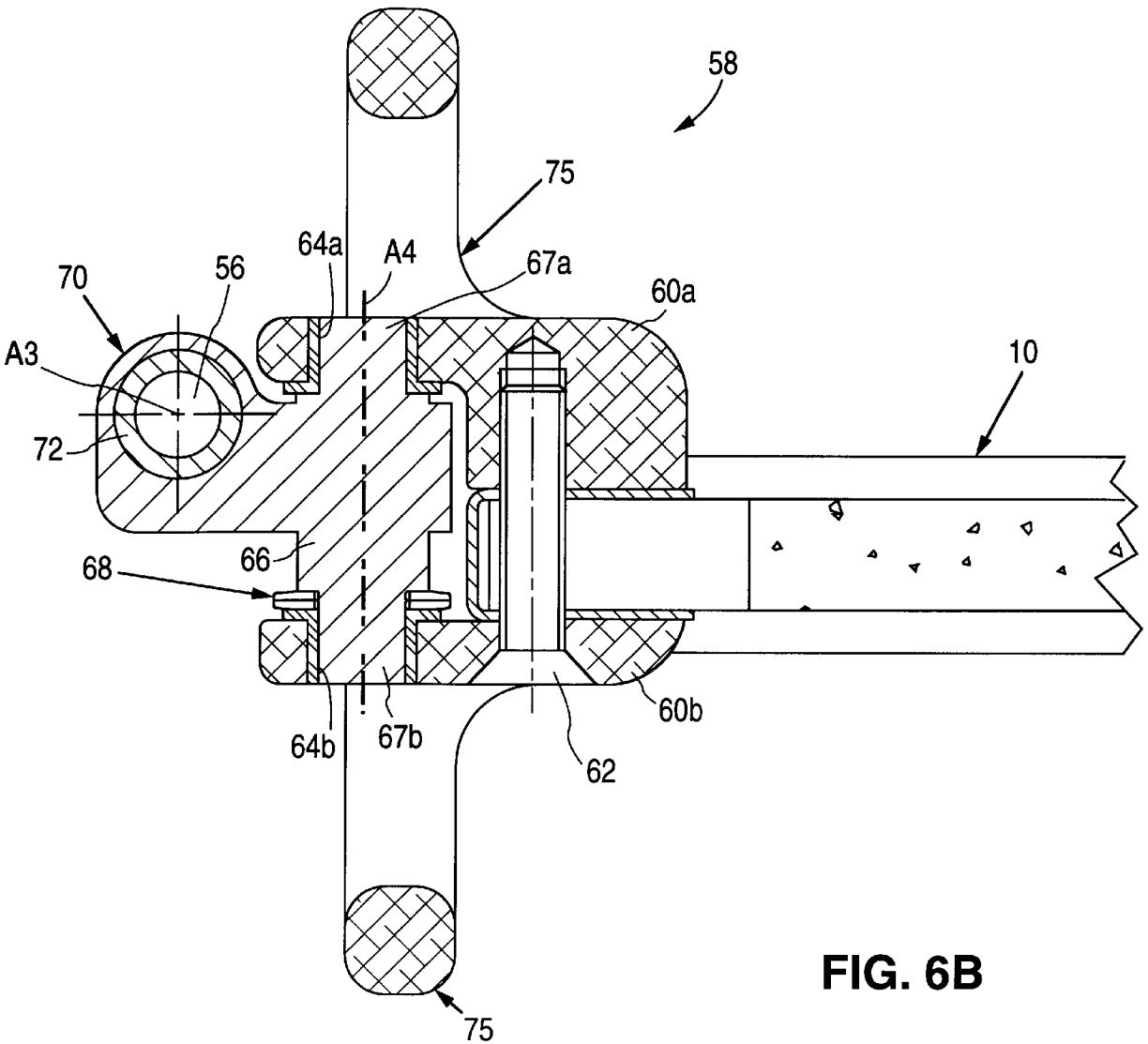
FIG. 6B is a cross-section view of a gimbal taken along the plane 6B—6B in FIG. 4.

The table top 10 is mounted to the rod 56 by means of a gimbal 58, a device which adds the degrees of freedom needed to allow the combined lateral rotation and trendelenberg movement provided by this table. FIGS. 6A and 6B illustrate the details of the gimbal 58. The gimbal 58 each includes an upper block 60*a* and a lower block 60*b*. Blocks 60*a*, 60*b* are secured by a bolt 62 to the top and bottom, respectively, of table top 10 at a position at or near the distal end of the table. An identical gimbal is mounted at or near the proximal end of the table.

Upper block 60*a* has a bore 64*a* which is aligned with a corresponding bore 64*b* in lower block 60*b*. A shaft 66 extends between the bores 64*a*, 64*b*, and is rotatable about a central axis A4, which is perpendicular to axis A3. Reduced diameter portions 67*a*, 67*b* of the shaft 66 are disposed in the bores 64*a*, 64*b* and a pair of Belville springs 68 preferably encircle the reduced diameter portion 67*b* to provide tolerance for slight variations in the width of the table top 10.

Member 70 extends laterally from the shaft 66 and includes a throughbore 72. Rod 56 (see FIG. 5) extends through the throughbore 72 such that member 70 is rotatable about the rod 56. Handles 75 extend from the upper and lower blocks 60*a*, 60*b*.

Clamps for Chest and Sacral Pad Attachment

Chest pads, sacral pads and the like are typically mounted to surgical tables using clamps that permit the pads to be raised and lowered, positioned at a selected location along the side rail of the table top, and moved laterally towards or away from the patient. Such clamps conventionally utilize a universal clamp having a single knob that, when loosened, permits simultaneous adjustment of pad height, lateral position and longitudinal position. These clamps make it sometimes difficult to adjust the pad position in only a single direction, since loosening the knob makes the pad easily moveable in any direction. The table of the present invention utilizes an improved clamp which permits separate adjustment of the lateral position, longitudinal position, and height of the support pads.

Figure 7:
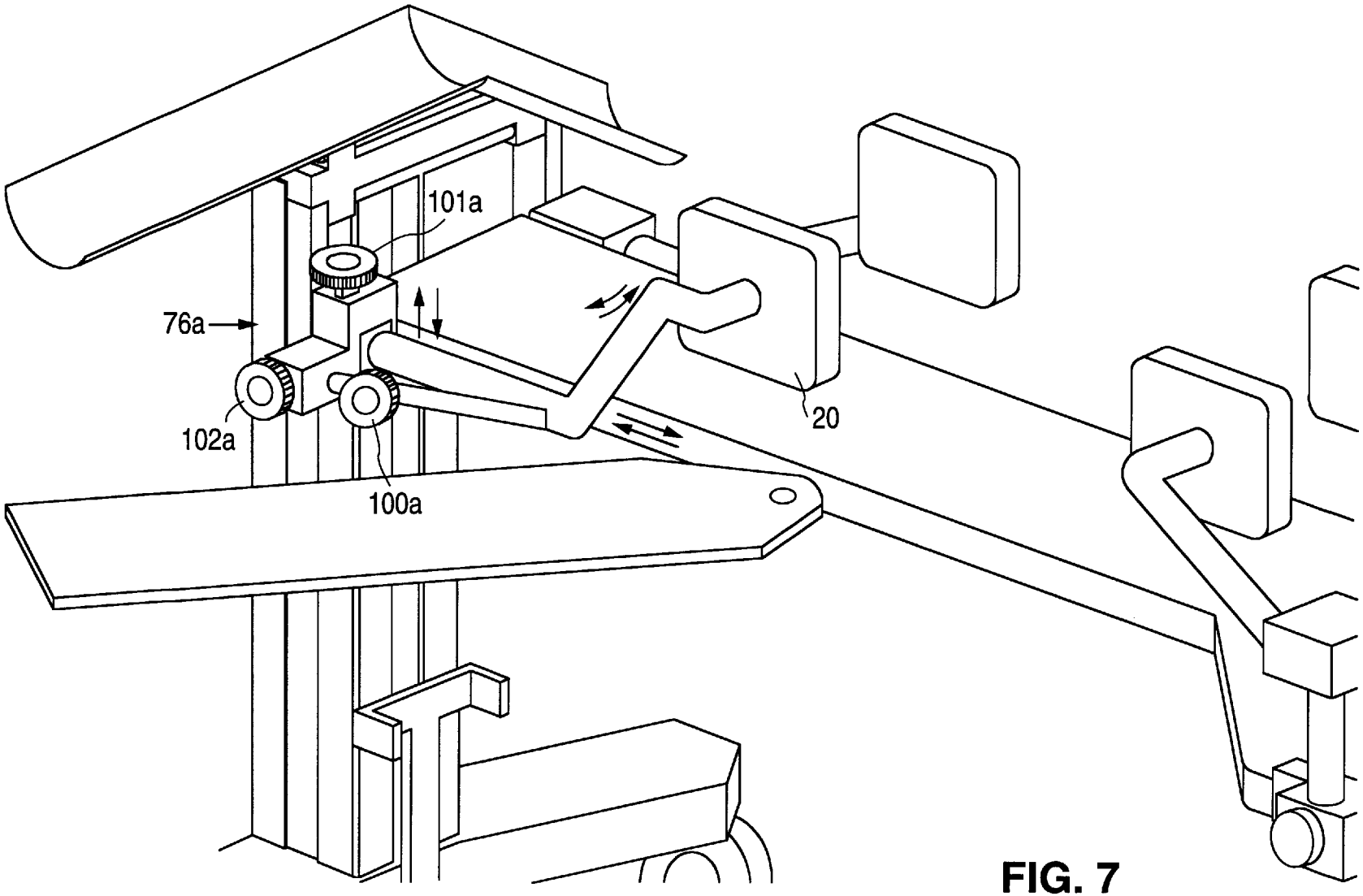
FIG. 7 is a partial perspective view of the table of FIG. 1A showing a clamp for attaching a chest pad to the table top.

FIG. 7 is a partial perspective view of the table according to the present invention, showing one embodiment of a clamp 76*a* for attaching a chest pad to the side rail of the table. Several details are omitted from this figure as it is intended only to generally illustrate the mechanisms for controlling movement of the chest pad. An identical clamp attaches the scapular pad to the opposite side rail 31 and controls movement in mirror image fashion.

Knobs 100*a*, 102*a* and 104*a* are separately useable to precisely position the chest pad 20. Specifically, knob 102*a* loosens the grip of the clamp 76*a* against rail 31 (not shown) and allows longitudinal positioning of the clamp along the rail 31; knob 100*a* loosens to allow the lateral position of the pad 20 to be modified; and rotation of knob 104*a* raises or lowers the height of the pad 20 relative to the table top 10.

Figure 8:
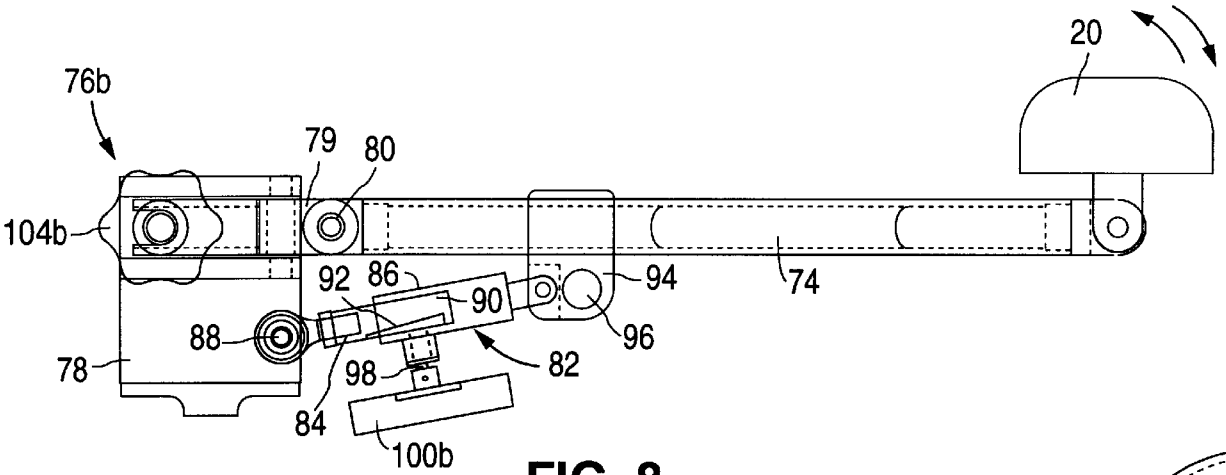
FIG. 8 is a plan view of a preferred embodiment of a clamp similar to the clamp of FIG. 7.
Figure 10:
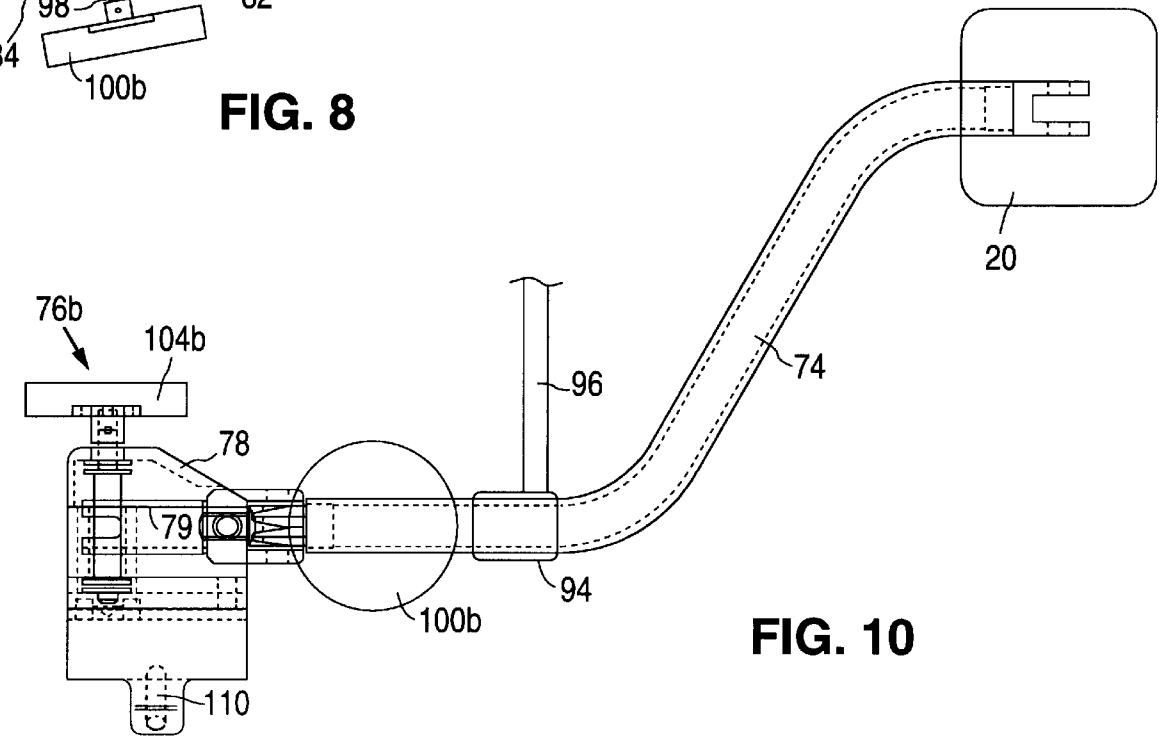
FIG. 10 is a side elevation view of the clamp of FIG. 8.
Figure 9:
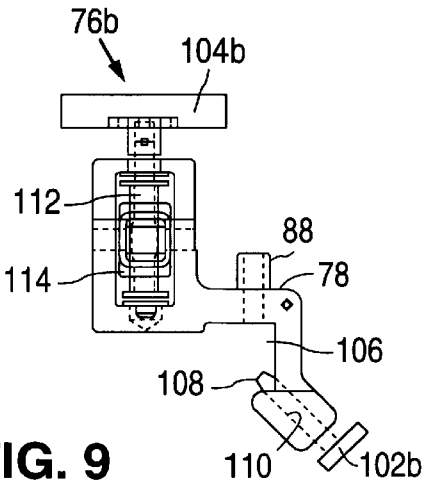
FIG. 9 is an end view of the clamp of FIG. 8.
Figure 11:
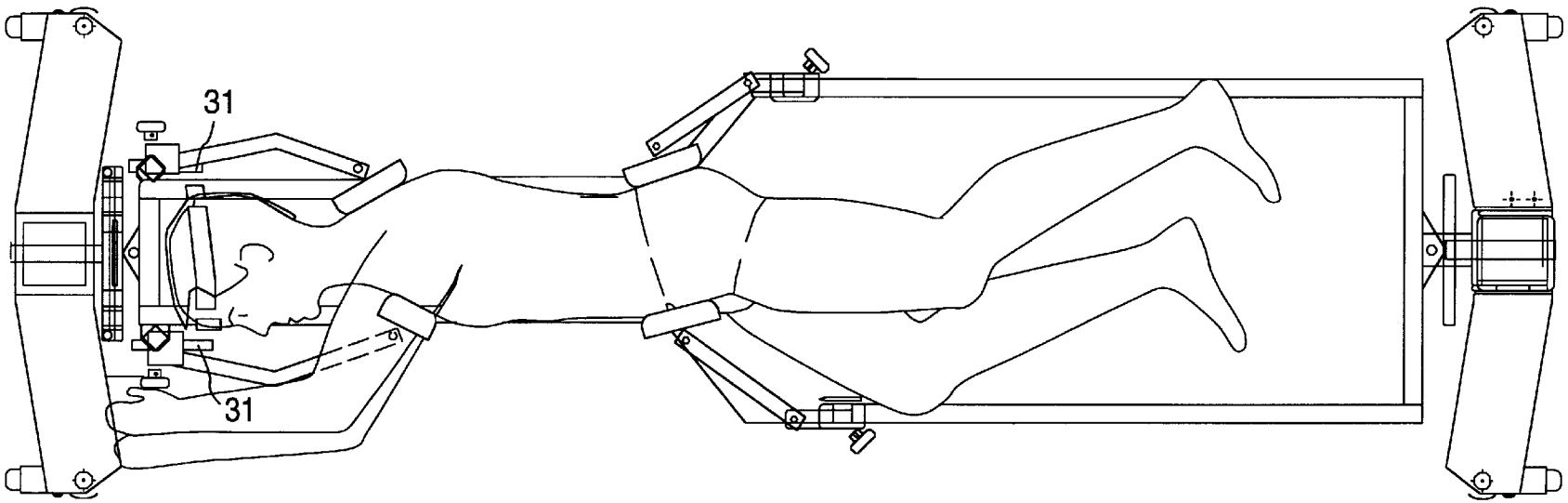
FIG. 11 is a top plan view of the surgical table of FIG. 1A, showing a patient laterally positioned on the table top.

A preferred embodiment of a clamp 76*b* is shown in FIGS. 8–10. It should be noted that, although this clamp is described as being for the chest and scapular pads, similar clamps may be used for the anterior thigh and sacral pads. Referring to FIGS. 8–10, clamp 76*b* includes a block 78 upon which three adjustment knobs, knobs 100*b*, 102*b* and 104*b* are located. A pivot arm 79 is pivotally mounted within a cutout 114 in the block 78. Attachment arm 74 supports chest pad 20 and is pivotally mounted to the arm 79 at pivot point 80 (FIG. 8). The knobs 100*b*, 102*b*, 104*b* provide for three separate adjustments which allows the chest and scapular pads to be precisely positioned laterally (i.e. towards or away from the patient), longitudinally (i.e. along the length of the table), and elevationally (i.e. in a direction towards or away from the table top surface).

First adjustment knob 100*b* operates to pivot attachment arm 74 about pivot point 80 to adjust the lateral positioning of the chest pad 20. Referring to FIG. 8, a telescoping rod 82 extends between the block 78 and the attachment arm 74. Telescoping rod 82 includes inner rod portion 84 and outer rod portion 86. Inner rod portion 84 has a first end 88 pivotally mounted to the block 78 by a spherical swivel joint and a second end 90 telescopically received within outer rod portion 86. A ramped cutout 92 is formed near the second end 90 and is oriented such that the shallower portion of the ramp is farthest from the second end 90.

Outer rod portion 86 is secured to a support block 94 which is in turn coupled to attachment arm 74. Although it is not shown in FIG. 1A, it is the support block 94 which supports the post 96 to which the upper arm board 18 is mounted.

A threaded screw 98 extends through the outer rod portion 86. First knob 100*b* is fixed to the screw 98 and allows the screw 98 to be manually advanced into, and withdrawn from, the outer rod portion 86. When tightened down, the screw 98 abuts the ramped cutout 92 of the inner rod portion 84 and locks the relative positions of the inner and outer rod portions 84, 86. When the screw 98 is loosened, the outer rod portion 86 can slide over the inner rod portion to increase or decrease the effective length of the telescoping rod 82. When the effective length of the rod 82 is increased, attachment arm 74 is pushed inwardly (i.e. towards the patient) and when the effective length of the rod 82 is decreased, attachment arm 74 is moved outwardly and thus away from the patient.

The ramped cutout 92 is beneficial in that it prevents the attachment arm 74 from moving very far if and when the knob 100*b* becomes slightly loosened, because the ramped surface will reengage the screw (by friction) after sliding only a small distance within the cutout.

Referring to FIG. 9, block 78 includes an angled section 106 which receives one of the rails 31 (see FIG. 2). A threaded screw 108 extends through a correspondingly threaded bore 110 in block 78 and into angled section 106. Second knob 102*b* is connected to the screw 108 and is used to tighten screw 108 into contact with rail 31 in order to secure the clamp 76 to the table. The longitudinal position of the clamp 76*b* (and thus of the chest pad 20) may be adjusted by loosening knob 102*b*, sliding clamp 76*b* in a distal or proximal direction along rail 31, and tightening knob 102*b* against rail 31 when the clamp 76 is in the desired longitudinal position. It should be noted that, for use with anterior thigh and sacral pads, this portion of the clamp would be modified to attach to table side 34 in a manner similar to that shown in FIG. 3C in order to accommodate the table of the side section 34 and to provide secure clamping.

Third knob 104*b* adjusts the position of the clamp and chest pad in a direction normal to the table top 10. Knob 104*b* is attached to a threaded screw 112 which extends into a cutout 114 in block 78. Pivotable arm 79 is seated partially within the cutout 114. The screw 112 acts as a leadscrew such that turning the screw causes arm 79 to pivot within the cutout 114. When the arm 79 moves up or down, it carries the attachment arm 74 with it and it therefore causes movement of the pad 20 upwardly or downwardly.

An example of a surgical table according to the present invention, as well as the arm boards, support pads, and head support, useful for securely attaching a patient to the table, is the Maximum Access Lateral Top available from Orthopedic Systems Inc., Union City, Calif.

Operation

Patient Transfer

Prior to transferring a patient onto the table, the arm boards 16, 18 and pads 20–26 are detached from the table and the transfer boards 17 (FIGS. 1A and 2) are attached to opposite sides of head section 10. A patient is then transferred onto the table top, and rolled into the lateral position (i.e. on his or her side). The lower arm board 16 is attached to the table using a connector 19 (FIG. 1A) which attaches to the underside of table top head section 28. Arm board 18 attaches to the post 96 shown in FIG. 10. The pads 20–26 and head support (not shown) are attached to the table and appropriately positioned to support the patient in the lateral position. The legs are secured using straps and boards (not shown) secured to side sections 34 of the table. Once the patient is secured in the lateral position, the transfer boards 17 are detached from the table.

Lateral Rotation

During the course of the surgical procedure, it may be beneficial to rotate the table top 10 laterally about its longitudinal axis, which is designated A2 in FIG. 1C. Ordinarily, the transfer locks and friction brakes (FIG. 4) on the head and foot posts 12, 14 are in the locked condition in order to prevent rotation of the shafts 48. Prior to rotating the table, the user releases the brake handles 50 (as well as the transfer locks, which are not shown) into their unlocked conditions and then rotates the table about the axis A2 by rotating the shafts 48 about axis A1. Once the table is rotated to the desired orientation, the brake handles 50 are re-engaged to lock the table in the angled condition. The table may be rotated as far as desired by the surgeon, and may even be rotated by 90 degrees to position the patient in a prone or supine position.

Trendelenberg or Reverse Trendelenberg

To elevate the foot section 30 of the table to position the patient in the trendelenberg (head lowered) condition, the electric motor or other elevation means in foot post 14 is activated via control box 44 to elevate upper post section 40 relative to lower post section 42. Alternatively, the trendelenberg position may be achieved by lowering the head section in a similar manner. Similarly, the foot section 30 may be lowered or the head section 28 elevated to achieve reverse trendelenberg.

Figure 12:
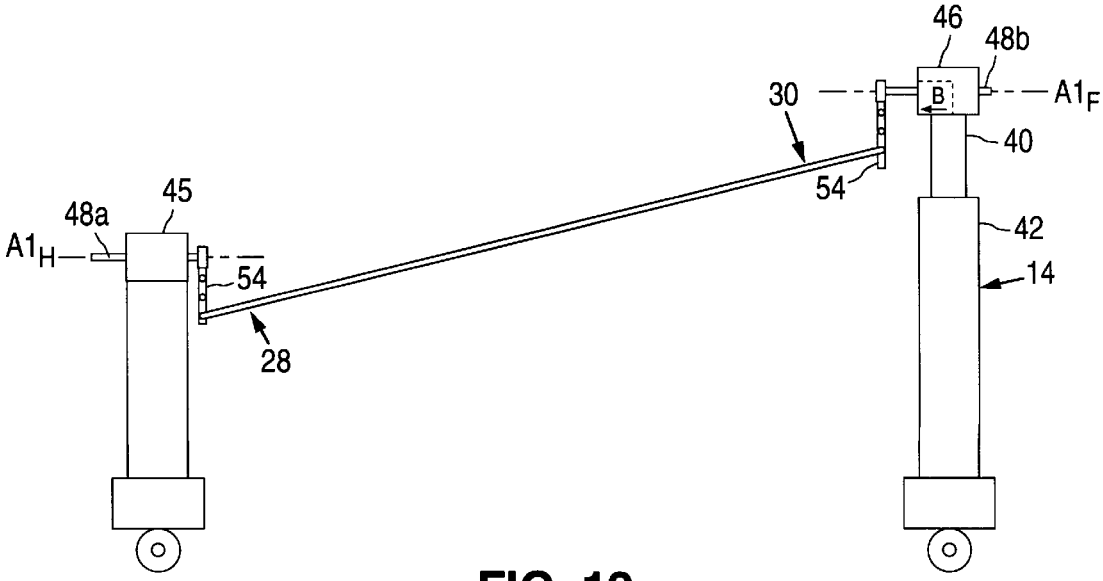
FIG. 12 is a side elevation view of the surgical table of FIG. 1A showing the table in the trendelenberg condition.

Referring to FIG. 12, as the head or foot post is raised or lowered to a height above or below the other post, the gimbals 58 at the head and foot ends of the table rotate about their corresponding rods 56 (FIG. 5) so that the rods 54 remain vertical and the shafts 48*a*, 48*b* associated with the head and foot posts, respectively, remain horizontal and parallel to one another. This prevents bending from occurring in the shafts 48 or other components. Moreover, because elevating the head or foot end of the table shortens the effective length of the table top extending between the head and foot posts, a portion of the foot brake housing compensates by sliding longitudinally relative to the foot post 14 as indicated by arrow B in FIG. 12. This aspect of the table is described in greater detail in application Ser. No. 08/512,281, now U.S. Pat. No. 5,658,315.

Combined Trendelenberg and Lateral Rotation

Figure 13:
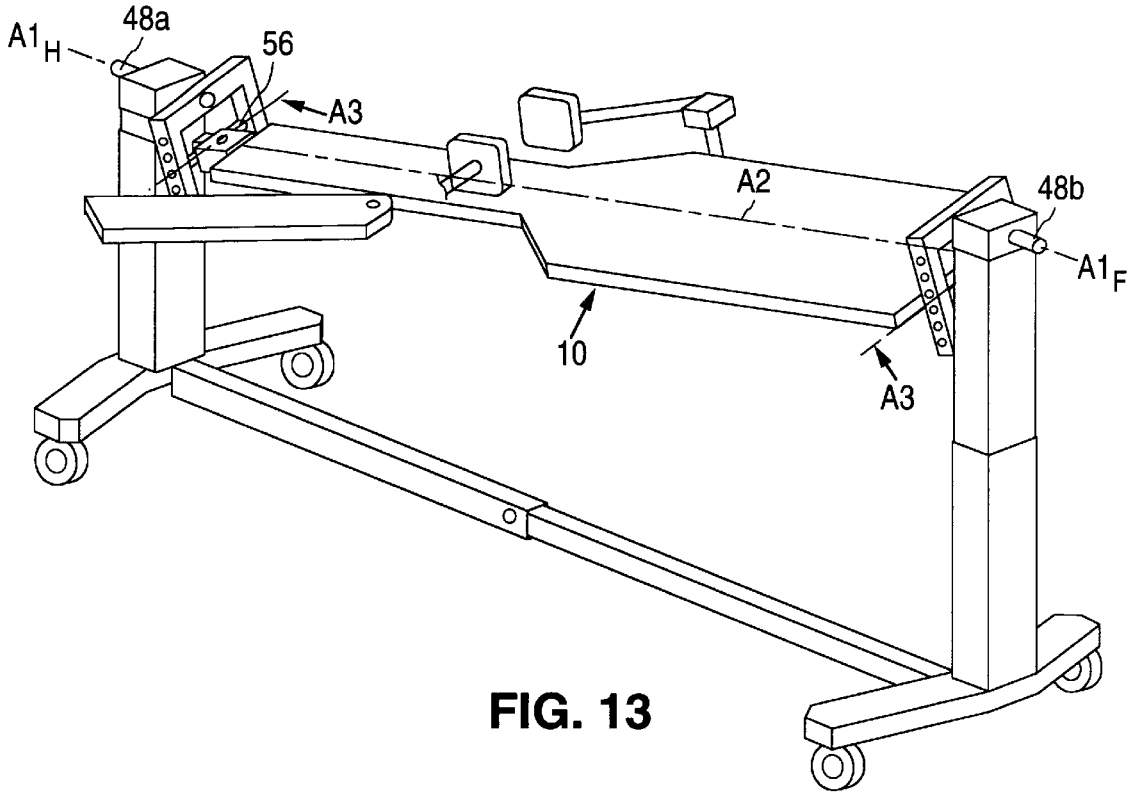
FIG. 13 is a perspective view similar to that of FIG. 13 showing the table laterally rotated and in the trendelenberg orientation.
Figure 14:
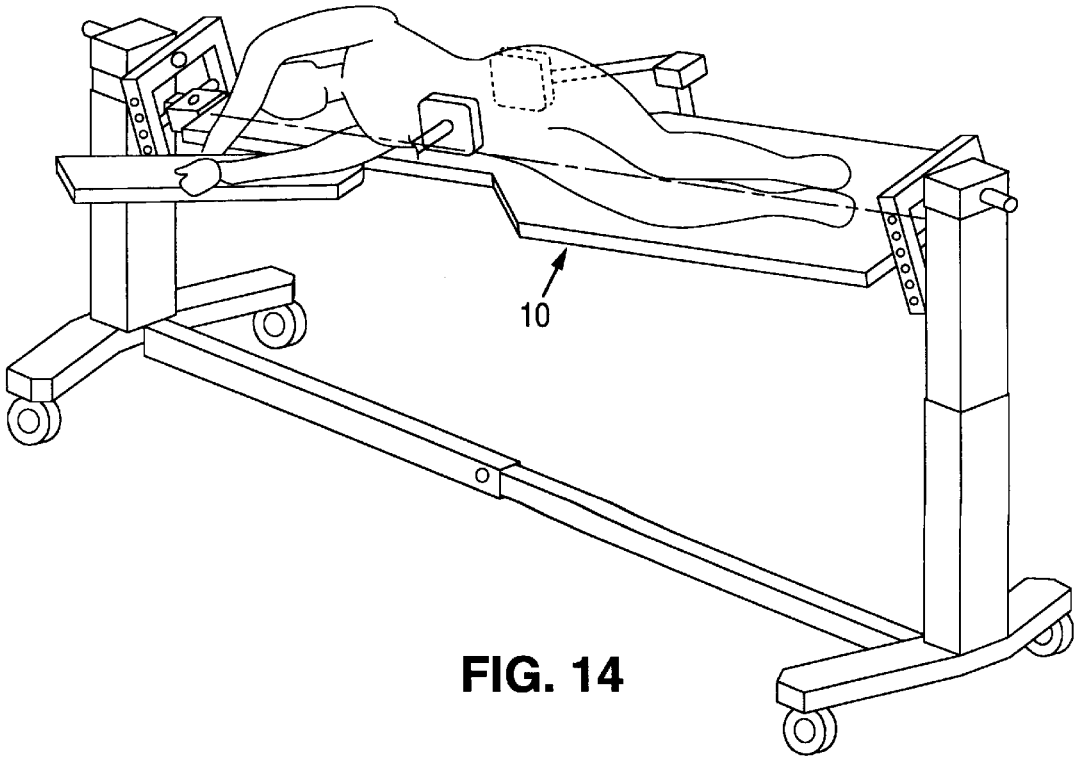
FIG. 14 is a perspective view similar to that of FIG. 15 showing a patient positioned on the table. For clarity, the upper arm board, chest pad, scapular pad, and head support are not shown.
Figure 15:
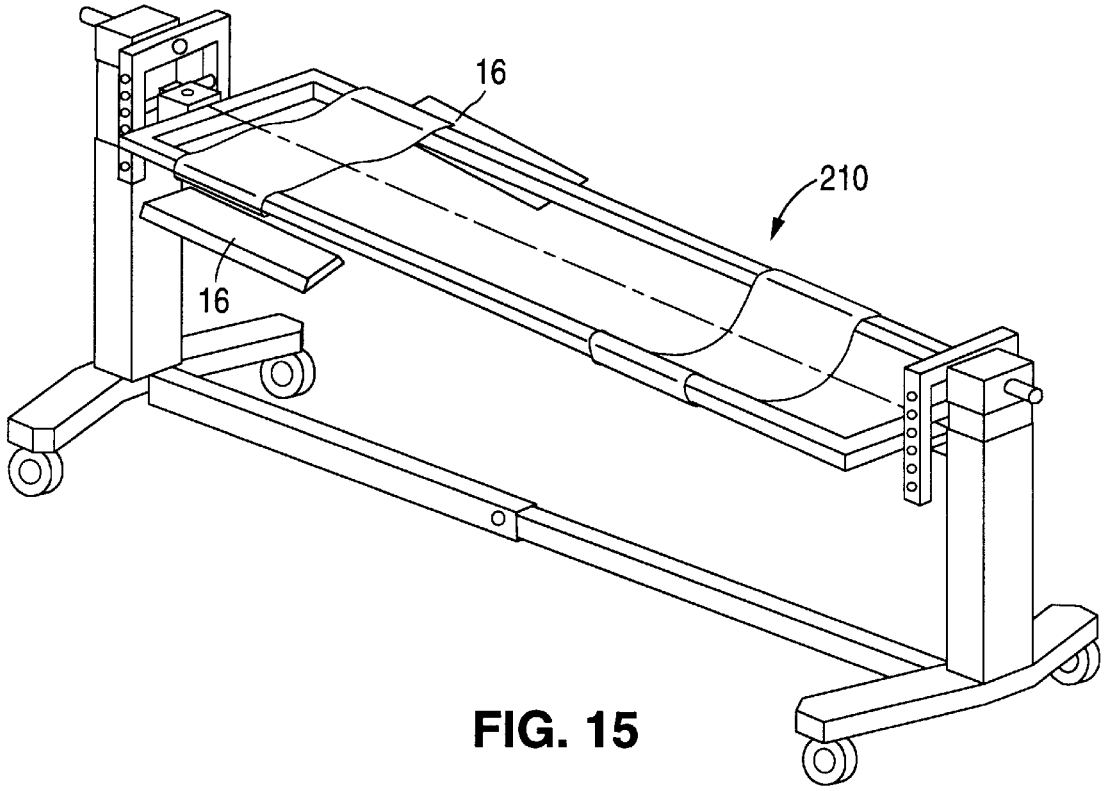
FIG. 15 is a perspective view of a table according to the present invention utilizing an alternative patient support system.
Figure 16:
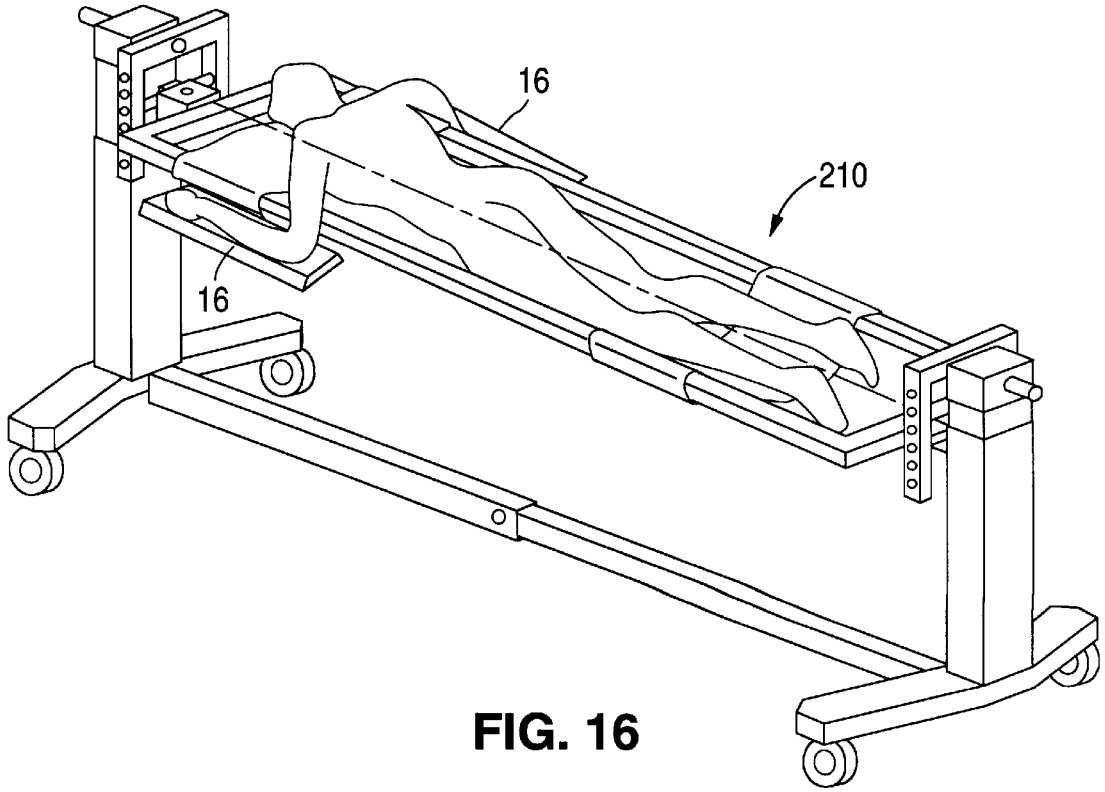
FIG. 16 is a perspective view similar to the view of FIG. 17 showing a patient positioned in the prone position on the alternative patient support system.

FIGS. 13 and 14 show the table of FIG. 1A in a combined trendelenberg and laterally rotated position. With the design of the present invention, the table may be laterally rotated by any amount, even while the patient is in a trendelenberg or reverse trendelenberg position.

When the table is in a laterally rotated condition and is being moved into a combined trendelenberg and laterally rotated condition, rotation of the gimbals 58 about rods 56 will not entirely relieve the stresses imparted on shafts 48*a*, 48*b*. This is because shaft axes $A1_H$ and $A1_F$ remain parallel with the horizontal while rod axes A3 do not. To avoid increased stresses on shafts 48*a*, 48*b* each gimbal 58 is designed such that it rotates about both gimbal axis A4 (FIG. 4) and rod axis A3 when the table is being moved from a lateral condition to a combined lateral/trendelenberg or lateral/reverse trendelenberg condition.

Finally, referring to FIG. 12, when the table is in the trendelenberg or reverse trendelenberg position, the axis $A1_H$ of the shaft 48*a* at the head end of the table is parallel to the axis $A1_F$ of the corresponding shaft 48*b* at the foot end of the table. Thus, lateral rotation of the table about its longitudinal axis A2 (FIG. 1C) is carried out by releasing the brakes at the head and foot posts and by then rotating shaft 48*a* about axis $A1_H$ and shaft 48*b* about axis $A1_F$. Again, increased stresses on shafts 48*a*, 48*b* are avoided by rotation about gimbal axes A4 (FIG. 4) and rod axes A3 when the table is being moved from a trendelenberg/reverse trendelenberg condition to a combined lateral/trendelenberg or lateral/reverse trendelenberg condition.

The surgical table of the present invention is therefore highly versatile in that it allows the table top to be freely moved between various lateral orientations and between varying degrees of trendelenberg and reverse trendelenberg, and it does so using a structure does not obstruct access to the table by C-arm imaging equipment.

In one application for the table of the present invention, surgical procedures may be carried out using simultaneous anterior and posterior access. For example, surgeons may be positioned at opposite sides of the table, such as in positions designated P1 and P2 in FIG. 2, and the table may be rotated back and forth to permit one surgeon to perform the portions of the surgery requiring an incision in the chest while the other surgeon performs those parts of the surgery requiring a incision in the back. Each surgeon may select the degree of lateral patient rotation, even 45 degrees or greater, which provides the best surgical access for the procedure. During such procedures, the table may be oriented so that the patient is in a trendelenberg position so that the patient's organs are shifted by gravity away from the surgical work area within the body.

In other applications for the table of the present invention, the table position may be adjusted throughout the procedure in order to optimize surgical access to difficult to reach locations within the patient's body.

Although a single embodiment of the present invention has been shown and described, it should be understood that innumerable modifications to the various components of the surgical table may be made without departing from the scope of the present invention. The preceding detailed description of the invention is not intended to limit the scope of the present invention. Instead, it is intended that the invention be limited only in terms of the following claims.

What is claimed is:

1. A surgical table comprising:

first and second support posts, and a table top coupled to the first and second support posts, the table top having first and second ends;

the first post extendable between retracted and extended positions, one of the retracted and extended positions corresponding to a first table position in which the first and second ends are substantially equidistant from a horizontal plane and the other of the retracted and extended positions corresponding to a second table position in which the first end is elevated relative to the second end, the table top being laterally rotatable when the table is in the first table position and when the table is in the second table position the first post oriented vertically when in the first position and when in the second position.

2. The surgical table of claim 1 in which the second support post is further extendable between retracted and extended positions.

3. The surgical table of claim 1 wherein:

the first end is rotatably coupled to the first support post by a first shaft having a first rotational axis;

the second end is rotatably coupled to the second support post by a second shaft having a second rotational axis;

the first and second rotational axes are co-axial when the first support post is in one of the retracted and extended positions; and the first and second rotational axes are parallel to one another when the first support post is in the other of the retracted and extended positions.

4. The surgical table of claim 1, further including:

a shaft having a first rotation axis, the shaft rotatably attached to the first post for rotation about the first rotation axis;

a support coupled to the first shaft;

a gimbal mounted to the table and coupled to the support for rotation about a second rotation axis when the table is moved between the first and second table positions.

5. The surgical table of claim 4 wherein the second rotation axis is substantially parallel to the first end.

6. A surgical table comprising:

first and second support posts;

a first shaft extending through the first post and a second shaft extending through the second post, each shaft having a rotational axis; and a table top coupled to the first and second shafts, laterally rotatable about the shafts and being further moveable between a first position in which the rotational axes of the first and second shafts are co-axial and a second position in which the rotational axis of the first shaft is elevated above the rotational axis of the second shaft.

7. The surgical table of claim 6 wherein the rotational axes of the shafts are parallel to one another when the table top is in the second position.

8. The surgical table of claim 6, further including:

first and second supports, each coupled to a respective one of the first shaft and second shafts;

first and second gimbals, each gimbal mounted to the table and being coupled to a respect one of the supports for rotation about a first gimbal axis when the table is moved between the first and second positions.

9. The surgical table of claim 8, wherein each gimbal includes:

a first portion secured to the table top; and a second portion coupled to the support, the first and second portions rotatably coupled for relative rotation about a second gimbal axis which is perpendicular to the first gimbal axis, the first portion rotatable about the second gimbal axis when the table top is being moved to a condition in which the table top is laterally rotated and in which the table top is in the second position.

10. The surgical table of claim 6 in which the table top has a first patient support section and a second patient support section, and in which the first patient support section is substantially narrower than the second patient support section to facilitate surgical access to a patient positioned on the table top.

11. The surgical table of claim 10 further including a transfer board attachable to the first patient support section for increasing the width of the first patient support section.

12. The surgical table of claim 6, wherein the first post extendable between retracted and extended positions, one of the retracted and extended positions corresponding to the first position and the other corresponding to the second position.

13. A surgical table comprising:

a pair of posts;

a table top extending between the posts;

a pair of gimbals, each mounted to one end of the table top, each gimbal including a first portion secured to the table top;

a second portion rotatably coupled with the first portion for relative rotation about a first gimbal axis;

a rod coupled with the second portion for relative rotation about a second gimbal axis which is perpendicular to the first gimbal axis;

a pair of supports, each attached to one of the rods; and a pair of shafts, each attached to one of the supports and each rotatably attached to a corresponding one of the posts.

14. A method of positioning a patient for surgery, comprising the steps of:

(a) providing a surgical table having a pair of posts and a table top extending between the posts, the table top having a head end, a foot end, and a longitudinal axis;

(b) securing a patient onto the table;

(c) elevating the foot end of the table to a height above that of the head end by extending the posts corresponding to the foot end of the table;

(d) laterally rotating the table top; and (e) performing a surgical procedure.

15. The method of claim 14 wherein the method includes the step of laterally rotating the table top during the surgical procedure.

16. The method of claim 14 wherein step (e) includes the steps of:

(i) performing surgery on the patient using an anterior approach;

(ii) laterally rotating the table top; and (iii) performing surgery on the patient using a posterior approach.

17. The method of claim 14 wherein the method includes the step of adjusting the relative heights of the head and foot ends during the surgical procedure.

18. The method of claim 14 wherein steps (c) and (d) are performed simultaneously.

19. The surgical table of claim 14, wherein step (b) includes positioning the patient in a lateral position.

20. A surgical table comprising:

first and second support posts, a shaft having a first rotation axis, the shaft rotatably attached to the first post for rotation about the first rotation axis;

a support coupled to the first shaft;

a gimbal coupled to the support;

a table top having a first end coupled to the gimbal and a second end coupled to the second support post, the table top laterally rotatable about the first rotation axis and further moveable between a first table position in which the first and second ends are substantially equidistant from a horizontal plane and a second table position in which the first end is elevated above the second end, wherein the gimbal includes:

a first member secured to the table top; and a second member rotatably coupled to the support for rotation about a second rotation axis when the table is moved between the first and second table positions, the first and second members rotatably coupled for relative rotation about a third rotation axis during movement of the table top to a condition in which the table top is laterally rotated and is in the second position, the third rotation axis being perpendicular to the second rotation axis.

21. A surgical table comprising:

first and second support posts, and an elongate table top coupled to the first and second support posts and having first and second ends, the table top laterally rotatable and further moveable between a first position in which the first and second ends are substantially equidistant from a horizontal plane and a second position in which the first end is elevated above the second end;

the table top including a first patient support section and a second patient support section, the first patient support section substantially narrower than the second patient support section to facilitate surgical access to a patient positioned on the table top.

22. A surgical table comprising:

first and second support posts, and an elongate table top coupled to the first and second support posts and having first and second ends, the table top laterally rotatable and further moveable between a first position in which the first and second ends are substantially equidistant from a horizontal plane and a second position in which the first end is elevated above the second end; and support pads attachable to the table for supporting a patient in a lateral condition, the support pads including:

a first pad including an attachment arm attachable to a block, the block including:

a clamp attachable to the table, the clamp including a loose condition in which the clamp is longitudinally slidable along the table and a secure condition in which the clamp is securely clamped to the table and further including a first actuator for adjusting the clamp between the first and second conditions, a member attached to the block and being moveable relative to the block between an elevated condition and a lowered condition, the member supporting the attachment arm, a second actuator attached to the block and engaged with the member for moving the member relative to the block, a telescoping shaft extending between the block and the attachment arm, the telescoping shaft selectably retractable to a first condition in which it has a first length and selectively extendable to a second condition in which it has a second length which is longer than the first length, and a third actuator engagable with the telescoping shaft to selectively engage the shaft in the first or second condition.

* * * * *

UNITED STATES PATENT AND TRADEMARK OFFICE

CERTIFICATE OF CORRECTION

PATENT NO. : 6,260,220 B1
DATED : July 17, 2001
INVENTOR(S) : Steve R. Lamb and Russell Klein It is certified that error appears in the above-identified patent and that said Letters Patent is hereby corrected as shown below:

Column 9,
Line 26, change "position" to -- position, --;

Column 10,
Line 3, change "first shaft and second shafts" to -- first and second shafts --; and
Line 5, change "respect one" to -- respective -- one --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*